United States Patent [19]

Hochella

[11] 4,180,699

[45] Dec. 25, 1979

[54] SHIELDED ELECTRICALLY CONDUCTOR

[75] Inventor: William A. Hochella, Warren, Pa.

[73] Assignee: GTE Sylvania Incorporated, Stamford, Conn.

[21] Appl. No.: 917,425

[22] Filed: Jun. 19, 1978

[51] Int. Cl.[2] ..... H01B 5/02

[52] U.S. Cl. ..... 174/126 CP; 428/614; 428/675; 428/928; 428/931

[58] Field of Search ..... 174/126 CP, 36; 428/607, 614, 675, 680, 926, 928, 931

[56] References Cited

U.S. PATENT DOCUMENTS

| | | | |
|---|---|---|---|
| 3,264,100 | 8/1966 | Ichinose et al. | 75/170 |
| 3,370,929 | 2/1968 | Mathias | 428/675 |
| 3,451,793 | 6/1969 | Matsushita | 428/611 |
| 3,489,660 | 1/1970 | Semienko et al. | 428/675 |
| 3,812,566 | 5/1974 | Clauss | 428/675 |
| 3,843,335 | 10/1974 | Holmen | 428/928 |
| 3,920,409 | 11/1975 | Taniguchi | 428/675 |

*Primary Examiner*—Arthur J. Steiner
*Attorney, Agent, or Firm*—Robert E. Walter

[57] ABSTRACT

A fine magnetically shielded conductor wire comprising a core and a metallic sheath metallurgically secured thereto. The sheath is a magnetically soft alloy having low conductivity and comprising about 75 to 85 percent nickel and about 15 to 25 percent iron.

5 Claims, No Drawings

SHIELDED ELECTRICALLY CONDUCTOR

BACKGROUND OF THE INVENTION

The present invention relates to a magnetically shielded conductor for use in applications where electromagnetic interference between closely spaced conductors cannot be tolerated.

The prior art has concentrated on obtaining effectively shielded conductors by surrounding the primary conductor with a secondary grounded conductor while separating the two conductors by a dielectric or insulating material. Coaxial cables are typical examples of this construction.

The construction of a coaxial cable requires the manufacture of two separate conductors and the separating material and final assembly of the components at or near finish size. Each connection requires two connectors or a connector of a specialized design.

U.S. Pat. No. 3,451,793 to Matsushita et al discloses a magnetic thin film wire having at least one thin film of an iron-nickel alloy of a compositional ratio of 50 percent of iron and 50 percent of nickel and at least one thin film of an iron nickel alloy of a compositional ratio of 21 percent of iron and 79 percent of nickel which are deposited in laminate arrangement. The wire is disclosed as being not subject to magnetostriction and having almost zero temperature coefficient.

U.S. Pat. No. 3,264,100 to Ichinose et al relates to soft magnetic materials of the nickel iron alloy type for use as magnetic cores in magnetic amplifiers and as memory elements. The use of 4-79 Moly Permalloy is disclosed therein.

It is an object of the present invention to provide a thin wire having shielding properties for eliminating interference between closely spaced conductors.

Other and further objects will become apparent from reading the following description.

In accordance with the principles of the present invention, there is provided a fine magnetically shielded conductor wire comprising a conductor core wire and a metallic sheath metallurgically secured to said conductor core wire, said sheath comprising a magnetically soft alloy comprising about 75 to 85 percent nickel and about 15 to 25 percent iron.

DETAILED DESCRIPTION

The magnetically shielded conductor wire of the present invention comprises a conductive core wire with a metallic sheath. The core preferably has an electrical conductivity that is greater than about 90 percent of the electrical conductivity value for pure copper. The aforementioned value of electrical conductivity is in reference to those known in the art as the International Annealed Copper Standards (IACS) wherein pure copper is rated as possessing 100 percent conductivity. More specifically, pure copper in accordance with the above standards is rated at 10.371 ohms circular mills/ft. When further describing the present invention, the defined percentages for conductivity will be in relation to the above value. Typical core materials are silver and copper. The core is preferably electrically pure copper which is substantially oxygen free.

The metallic sheath is metallurgically secured to the conductive core wire. The sheath is of substantial uniform thickness and surrounds or covers the core conductor. The shielding material or sheath comprises a magnetically soft alloy which does not retain magnetism after it is subjected to an applied magnetic field. The alloy possesses high permeability which permits the magnetic lines of force to be contained within the material. For a suitable shielding effect to be achieved, the sheath should be sufficiently thick in relation to the core. Typically the sheath comprises from about 5 to about 40 percent of the total cross-sectional area of the shielded conductor wire. The sheath preferably has a low conductivity of about less than 3 percent I.A.C.S. The greater portion of a current applied to such a shielded wire will flow through the highly conductive core in preference to the sheath and the effect of the electromagnetic field created by the current flow is minimized by the permeable magnetically soft alloy surrounding the core.

Typically sheath alloys comprise about 75 to 85 percent nickel and about 15 to 25 percent iron. Typical sheath alloys are 78-Permalloy comprising 78 percent nickel with the remaining portion iron and Mu Metal comprising 75 percent nickel, 18 percent iron, 2 percent chromium and 5 percent copper.

Preferably the sheath comprises about 2 to about 5 percent molybdenum, about 15 to about 23 percent iron and from about 75 to about 85 percent nickel by weight. Even more preferably, the sheath comprises 4-79 Moly Permalloy which comprises about 4 percent molybdenum, about 79 percent nickel and the remainder comprising iron. 4-79 Permalloy typically contains 0.3 percent manganess and may contain other impurities. Except for the impurities and other minor ingredients such as manganese, the remainder comprises about 17 percent by weight iron. Super malloy which comprises about 79 percent nickel, 15 percent iron, 5 percent molybdenum and remainder impurities is also a more preferred sheath material.

The wire of the present invention is ideally suited for electrical wires in applications requiring very fine or thin wire of a diameter of from about 0.005 inch (0.127 mm) to about 0.032 inch (0.813 mm). The wire has particular application for use with miniaturized circuits where large amounts of thin wire are in close proximity to provide interconnection between the elements of the circuit board by a wire wrapping process.

The preferred method of making the metallurgically bonded shielded conductor wire of the present invention is by conventional wire drawing techniques. A rod of the electrically conductive core material, preferably copper, is covered with a close fitting sleeve of the sheath material. The composite rod is then reduced by known wire drawing techniques to the desired wire size. These techniques which are well known in the prior art include drawing the wire through a series of proggressively smaller dyes. The use of conventional methods results in the sheath being metallurgically bonded to the core conductor.

All percentage composition figures referred to hereinbefore are by weight percent.

While there have been described various embodiments of the present invention, the methods and particular described structure are not intended to be understood as limiting the scope of the invention.

What is claimed is:

1. A fine magnetically shielded conductor wire consisting of a conductive copper core and a magnetically soft alloy metallic sheath metallurgically secured to said conductive core, said sheath consisting essentially of about 2 to about 5 percent by weight molybdenum, about 15 to about 23 percent by weight iron and about 75 to about 85 percent by weight nickel.

2. A fine magnetically shielded conductor wire according to claim 1 wherein said core wire has a conductivity greater than about 90 percent I.A.C.S. and said sheath has a conductivity less than about 3 percent I.A.C.S.

3. A fine magnetically shielded conductor wire according to claim 2 wherein said sheath has a substantially uniform thickness and comprises from about 5 to about 40 percent of the total cross-sectional area of the shielded conductor wire.

4. A fine magnetically shielded conductor wire according to claim 3 comprising about 4 percent molybdenum, about 17 percent iron, and about 79 percent nickel.

5. A fine magnetically shielded conductor wire according to claim 4 having a diameter of from about 0.005 inch to about 0.032 inch.

* * * * *